US007652632B2

(12) United States Patent
Shtrom

(10) Patent No.: US 7,652,632 B2
(45) Date of Patent: Jan. 26, 2010

(54) MULTIBAND OMNIDIRECTIONAL PLANAR ANTENNA APPARATUS WITH SELECTABLE ELEMENTS

(75) Inventor: Victor Shtrom, Sunnyvale, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 243 days.

(21) Appl. No.: 11/414,117

(22) Filed: Apr. 28, 2006

(65) Prior Publication Data

US 2006/0192720 A1 Aug. 31, 2006

Related U.S. Application Data

(63) Continuation-in-part of application No. 11/010,076, filed on Dec. 9, 2004, now Pat. No. 7,292,198.

(60) Provisional application No. 60/602,711, filed on Aug. 18, 2004, provisional application No. 60/603,157, filed on Aug. 18, 2004.

(51) Int. Cl.
*H01Q 9/28* (2006.01)

(52) U.S. Cl. ..... 343/795; 343/700 MS; 343/820; 343/853; 343/893

(58) Field of Classification Search ..... 343/700 MS, 343/730, 745, 795, 810, 820, 797, 893, 822, 343/853

See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld |
| 3,967,067 | A | 6/1976 | Potter |
| 3,982,214 | A | 9/1976 | Burns |
| 3,991,273 | A | 11/1976 | Mathes |
| 4,001,734 | A | 1/1977 | Burns |

(Continued)

FOREIGN PATENT DOCUMENTS

| | | | |
|---|---|---|---|
| EP | 352787 | A2 | 1/1990 |

(Continued)

OTHER PUBLICATIONS

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

(Continued)

*Primary Examiner*—Douglas W Owens
*Assistant Examiner*—Chuc D Tran
(74) *Attorney, Agent, or Firm*—Carr & Ferrell LLP

(57) ABSTRACT

A system and method for a wireless link to a remote receiver includes a multiband communication device for generating RF and a multiband planar antenna apparatus for transmitting the RF. The multiband planar antenna apparatus includes selectable antenna elements, each of which has gain and a directional radiation pattern. Switching different antenna elements results in a configurable radiation pattern. One or more directors and/or one or more reflectors may be included to constrict the directional radiation pattern. A multiband coupling network selectively couples the multiband communication device and the multiband planar antenna apparatus.

16 Claims, 8 Drawing Sheets

U.S. PATENT DOCUMENTS

| | | | | |
|---|---|---|---|---|
| 4,176,356 | A | 11/1979 | Foster et al. | |
| 4,193,077 | A | 3/1980 | Greenberg et al. | |
| 4,253,193 | A | 2/1981 | Kennard | |
| 4,305,052 | A | 12/1981 | Baril et al. | |
| 4,513,412 | A | 4/1985 | Cox | |
| 4,554,554 | A | 11/1985 | Olesen et al. | |
| 4,733,203 | A | 3/1988 | Ayasli | |
| 4,814,777 | A | 3/1989 | Monser | |
| 5,063,574 | A | 11/1991 | Moose | |
| 5,097,484 | A | 3/1992 | Akaiwa | |
| 5,173,711 | A | 12/1992 | Takeuchi et al. | |
| 5,203,010 | A | 4/1993 | Felix | |
| 5,208,564 | A | 5/1993 | Burns et al. | |
| 5,220,340 | A | 6/1993 | Shafai | |
| 5,282,222 | A | 1/1994 | Fattouche et al. | |
| 5,291,289 | A | 3/1994 | Hulyalkar et al. | |
| 5,311,550 | A | 5/1994 | Fouche et al. | |
| 5,373,548 | A | 12/1994 | McCarthy | |
| 5,507,035 | A | 4/1996 | Bantz | |
| 5,532,708 | A * | 7/1996 | Krenz et al. | 343/795 |
| 5,559,800 | A | 9/1996 | Mousseau et al. | |
| 5,754,145 | A * | 5/1998 | Evans | 343/795 |
| 5,767,755 | A | 6/1998 | Kim et al. | |
| 5,767,809 | A | 6/1998 | Chuang et al. | |
| 5,786,793 | A | 7/1998 | Maeda et al. | |
| 5,802,312 | A | 9/1998 | Lazaridis et al. | |
| 5,964,830 | A | 10/1999 | Durett | |
| 5,990,838 | A | 11/1999 | Burns et al. | |
| 6,011,450 | A | 1/2000 | Miya | |
| 6,031,503 | A | 2/2000 | Preiss, II et al. | |
| 6,034,638 | A | 3/2000 | Thiel et al. | |
| 6,052,093 | A | 4/2000 | Yao et al. | |
| 6,091,364 | A | 7/2000 | Murakami et al. | |
| 6,094,177 | A | 7/2000 | Yamamoto | |
| 6,097,347 | A | 8/2000 | Duan et al. | |
| 6,104,356 | A | 8/2000 | Hikuma et al. | |
| 6,169,523 | B1 | 1/2001 | Ploussios | |
| 6,266,528 | B1 | 7/2001 | Farzaneh | |
| 6,292,153 | B1 | 9/2001 | Aiello et al. | |
| 6,307,524 | B1 | 10/2001 | Britain | |
| 6,317,599 | B1 | 11/2001 | Rappaport et al. | |
| 6,323,810 | B1 | 11/2001 | Poilasne et al. | |
| 6,326,922 | B1 | 12/2001 | Hegendoerfer | |
| 6,337,628 | B2 | 1/2002 | Campana, Jr. | |
| 6,337,668 | B1 | 1/2002 | Ito et al. | |
| 6,339,404 | B1 * | 1/2002 | Johnson et al. | 343/794 |
| 6,345,043 | B1 | 2/2002 | Hsu | |
| 6,356,242 | B1 | 3/2002 | Ploussios | |
| 6,356,243 | B1 | 3/2002 | Schneider et al. | |
| 6,356,905 | B1 | 3/2002 | Gershman et al. | |
| 6,377,227 | B1 | 4/2002 | Zhu et al. | |
| 6,392,610 | B1 | 5/2002 | Braun et al. | |
| 6,404,386 | B1 | 6/2002 | Proctor, Jr. et al. | |
| 6,407,719 | B1 | 6/2002 | Ohira et al. | |
| RE37,802 | E | 7/2002 | Fattouche et al. | |
| 6,414,647 | B1 | 7/2002 | Lee | |
| 6,424,311 | B1 | 7/2002 | Tsai et al. | |
| 6,442,507 | B1 | 8/2002 | Skidmore et al. | |
| 6,445,688 | B1 | 9/2002 | Garces et al. | |
| 6,456,242 | B1 | 9/2002 | Crawford | |
| 6,493,679 | B1 | 12/2002 | Rappaport et al. | |
| 6,496,083 | B1 | 12/2002 | Kushitani et al. | |
| 6,498,589 | B1 | 12/2002 | Horii | |
| 6,499,006 | B1 | 12/2002 | Rappaport et al. | |
| 6,507,321 | B2 | 1/2003 | Oberschmidt et al. | |
| 6,531,985 | B1 | 3/2003 | Jones et al. | |
| 6,583,765 | B1 | 6/2003 | Schamberger et al. | |
| 6,586,786 | B2 | 7/2003 | Kitazawa et al. | |
| 6,611,230 | B2 | 8/2003 | Phelan | |
| 6,625,454 | B1 | 9/2003 | Rappaport et al. | |
| 6,633,206 | B1 | 10/2003 | Kato | |
| 6,642,889 | B1 | 11/2003 | McGrath | |
| 6,674,459 | B2 | 1/2004 | Ben-Shachar et al. | |
| 6,701,522 | B1 | 3/2004 | Rubin et al. | |
| 6,724,346 | B2 | 4/2004 | Le Bolzer | |
| 6,725,281 | B1 | 4/2004 | Zintel et al. | |
| 6,741,219 | B2 * | 5/2004 | Shor | 343/795 |
| 6,747,605 | B2 * | 6/2004 | Lebaric et al. | 343/795 |
| 6,753,814 | B2 | 6/2004 | Killen et al. | |
| 6,762,723 | B2 | 7/2004 | Nallo et al. | |
| 6,779,004 | B1 | 8/2004 | Zintel | |
| 6,819,287 | B2 | 11/2004 | Sullivan et al. | |
| 6,839,038 | B2 * | 1/2005 | Weinstein | 343/795 |
| 6,859,176 | B2 * | 2/2005 | Choi | 343/700 MS |
| 6,859,182 | B2 * | 2/2005 | Horii | 343/727 |
| 6,876,280 | B2 | 4/2005 | Nakano | |
| 6,876,836 | B2 | 4/2005 | Lin et al. | |
| 6,888,504 | B2 | 5/2005 | Chiang et al. | |
| 6,888,893 | B2 | 5/2005 | Li et al. | |
| 6,892,230 | B1 | 5/2005 | Gu et al. | |
| 6,903,686 | B2 * | 6/2005 | Vance et al. | 343/700 MS |
| 6,906,678 | B2 | 6/2005 | Chen | |
| 6,910,068 | B2 | 6/2005 | Zintel et al. | |
| 6,914,581 | B1 * | 7/2005 | Popek | 343/909 |
| 6,924,768 | B2 | 8/2005 | Wu et al. | |
| 6,931,429 | B2 | 8/2005 | Gouge et al. | |
| 6,941,143 | B2 | 9/2005 | Mathur | |
| 6,943,749 | B2 | 9/2005 | Paun | |
| 6,950,019 | B2 | 9/2005 | Bellone et al. | |
| 6,950,069 | B2 * | 9/2005 | Gaucher et al. | 343/702 |
| 6,961,028 | B2 | 11/2005 | Joy et al. | |
| 6,965,353 | B2 * | 11/2005 | Shirosaka et al. | 343/802 |
| 6,973,622 | B1 | 12/2005 | Rappaport et al. | |
| 6,975,834 | B1 | 12/2005 | Forster | |
| 6,980,782 | B1 * | 12/2005 | Braun et al. | 455/277.2 |
| 7,023,909 | B1 * | 4/2006 | Adams et al. | 375/222 |
| 7,034,769 | B2 * | 4/2006 | Surducan et al. | 343/793 |
| 7,034,770 | B2 | 4/2006 | Yang et al. | |
| 7,043,277 | B1 | 5/2006 | Pfister | |
| 7,050,809 | B2 | 5/2006 | Lim | |
| 7,053,844 | B2 * | 5/2006 | Gaucher et al. | 343/702 |
| 7,064,717 | B2 | 6/2006 | Kaluzni et al. | |
| 7,085,814 | B1 | 8/2006 | Gandhi et al. | |
| 7,088,299 | B2 * | 8/2006 | Siegler et al. | 343/745 |
| 7,089,307 | B2 | 8/2006 | Zintel et al. | |
| 7,130,895 | B2 | 10/2006 | Zintel et al. | |
| 7,171,475 | B2 | 1/2007 | Weisman et al. | |
| 7,277,063 | B2 * | 10/2007 | Shirosaka et al. | 343/850 |
| 7,312,762 | B2 | 12/2007 | Puente Ballarda et al. | |
| 7,319,432 | B2 * | 1/2008 | Andersson | 343/702 |
| 2001/0046848 | A1 | 11/2001 | Kenkel | |
| 2002/0031130 | A1 | 3/2002 | Tsuchiya et al. | |
| 2002/0047800 | A1 | 4/2002 | Proctor, Jr. et al. | |
| 2002/0080767 | A1 | 6/2002 | Lee | |
| 2002/0084942 | A1 | 7/2002 | Tsai et al. | |
| 2002/0101377 | A1 | 8/2002 | Crawford | |
| 2002/0105471 | A1 | 8/2002 | Kojima et al. | |
| 2002/0112058 | A1 | 8/2002 | Weisman et al. | |
| 2002/0158798 | A1 | 10/2002 | Chiang et al. | |
| 2002/0170064 | A1 | 11/2002 | Monroe et al. | |
| 2003/0026240 | A1 | 2/2003 | Eyuboglu et al. | |
| 2003/0030588 | A1 | 2/2003 | Kalis et al. | |
| 2003/0063591 | A1 | 4/2003 | Leung et al. | |
| 2003/0122714 | A1 | 7/2003 | Wannagot et al. | |
| 2003/0169330 | A1 | 9/2003 | Ben-Shachar et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017860 | A1 | 1/2004 | Liu | |

| | | | |
|---|---|---|---|
| 2004/0027291 | A1 | 2/2004 | Zhang et al. |
| 2004/0027304 | A1 | 2/2004 | Chiang et al. |
| 2004/0032378 | A1 | 2/2004 | Volman et al. |
| 2004/0036651 | A1 | 2/2004 | Toda |
| 2004/0036654 | A1 | 2/2004 | Hsieh |
| 2004/0041732 | A1 | 3/2004 | Aikawa et al. |
| 2004/0048593 | A1 | 3/2004 | Sano |
| 2004/0058690 | A1 | 3/2004 | Ratzel et al. |
| 2004/0061653 | A1 | 4/2004 | Webb et al. |
| 2004/0070543 | A1 | 4/2004 | Masaki |
| 2004/0080455 | A1 | 4/2004 | Lee |
| 2004/0095278 | A1 | 5/2004 | Kanemoto et al. |
| 2004/0114535 | A1 | 6/2004 | Hoffmann et al. |
| 2004/0125777 | A1 | 7/2004 | Doyle et al. |
| 2004/0145528 | A1 | 7/2004 | Mukai et al. |
| 2004/0160376 | A1 | 8/2004 | Hornsby et al. |
| 2004/0190477 | A1 | 9/2004 | Olson et al. |
| 2004/0203347 | A1 | 10/2004 | Nguyen |
| 2004/0260800 | A1 | 12/2004 | Gu et al. |
| 2005/0022210 | A1 | 1/2005 | Zintel et al. |
| 2005/0041739 | A1 | 2/2005 | Li et al. |
| 2005/0042988 | A1 | 2/2005 | Hoek et al. |
| 2005/0048934 | A1 * | 3/2005 | Rawnick et al. ..... 455/107 |
| 2005/0074108 | A1 | 4/2005 | Dezonno et al. |
| 2005/0097503 | A1 | 5/2005 | Zintel et al. |
| 2005/0128983 | A1 | 6/2005 | Kim et al. |
| 2005/0135480 | A1 | 6/2005 | Li et al. |
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner et al. |
| 2005/0180381 | A1 | 8/2005 | Retzer et al. |
| 2005/0188193 | A1 | 8/2005 | Kuehnel et al. |
| 2005/0240665 | A1 | 10/2005 | Gu et al. |
| 2005/0267935 | A1 | 12/2005 | Gandhi et al. |
| 2006/0094371 | A1 | 5/2006 | Nguyen |
| 2006/0098607 | A1 | 5/2006 | Zeng et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184660 | A1 | 8/2006 | Rao et al. |
| 2006/0184661 | A1 | 8/2006 | Weisman et al. |
| 2006/0184693 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227761 | A1 | 10/2006 | Scott, III et al. |
| 2006/0239369 | A1 | 10/2006 | Lee |
| 2006/0262015 | A1 * | 11/2006 | Thornell-Pers et al. ..... 343/702 |
| 2006/0291434 | A1 | 12/2006 | Gu et al. |
| 2007/0027622 | A1 | 2/2007 | Cleron et al. |
| 2007/0135167 | A1 | 6/2007 | Liu |

FOREIGN PATENT DOCUMENTS

| | | | |
|---|---|---|---|
| EP | 0 534 612 | | 3/1993 |
| EP | 0756381 | A2 | 1/1997 |
| EP | 1152542 | A1 | 11/2001 |
| EP | 1 376 920 | | 6/2002 |
| EP | 1 315 311 | | 5/2003 |
| EP | 1 450 521 | | 8/2004 |
| EP | 1 608 108 | | 12/2005 |
| JP | 03038933 | | 2/1991 |
| JP | 2008/088633 | | 2/1996 |
| JP | 2001/057560 | | 2/2002 |
| JP | 2005/354249 | | 12/2005 |
| JP | 2006/060408 | | 3/2006 |
| WO | WO 90/04893 | | 5/1990 |
| WO | WO 02/25967 | | 3/2002 |
| WO | WO 03/079484 | | 9/2003 |

OTHER PUBLICATIONS

"Authorization of spread spectrum and other wideband emissions not presently provided for in the FCC Rules and Regulations," Before the Federal Communications Commission, FCC 81-289, 87 F.C.C.2d 876, Gen Docket No. 81-413, Jun. 30, 1981.

RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.

Chang, Robert W., "Synthesis of Band-Limited Orthogonal Signals for Multichannel Data Transmission," The Bell System Technical Journal, Dec. 1966, pp. 1775-1796.

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Saltzberg, Burton R., "Performance of an Efficient Parallel Data Transmission System," IEEE Transactions on Communication Technology, vol. Com-15, No. 6, Dec. 1967, pp. 805-811.

Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.

Moose, Paul H., "Differential Modulation and Demodulation of Multi-Frequency Digital Communications Signals," 1990 IEEE,CH2831-6/90/0000-0273.

Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.

Casas, Eduardo F., et al., "OFDM for Data Communication over Mobile Radio FM Channels; Part II: Performance Improvement," Department of Electrical Engineering, University of British Columbia.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.

Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.

Alard, M., et al., "Principles of Modulation and Channel Coding for Digital Broadcasting for Mobile Receivers," 8301 EBU Review Technical, Aug. 1987, No. 224, Brussels, Belgium.

Berenguer, Inaki, et al., "Adaptive MIMO Antenna Selection," Nov. 2003.

Gaur, Sudhanshu, et al., "Transmit/Receive Antenna Selection for MIMO Systems to Improve Error Performance of Linear Receivers," School of ECE, Georgia Institute of Technology, Apr. 4, 2005.

Sadek, Mirette, et al., "Active Antenna Selection in Multiuser MIMO Communications," IEEE Transactions on Signal Processing, vol. 55, No. 4, Apr. 2007, pp. 1498-1510.

Molisch, Andreas F., et al., "MIMO Systems with Antenna Selection-an Overview," Draft, Dec. 31, 2003.

Ken Tang, et al., "MAC Layer Broadcast Support in 802.11 Wireless Networks," Computer Science Department, University of California, Los Angeles, 2000 IEEE, pp. 544-548.

Ken Tang, et al., "MAC Reliable Broadcast in Ad Hoc Networks," Computer Science Department, University of California, Los Angeles, 2001 IEEE, pp. 1008-1013.

Vincent D. Park, et al., "A Performance Comparison of the Temporally-Ordered Routing Algorithm and Ideal Link-State Routing," IEEE, Jul. 1998, pp. 592-598.

Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology.

Dell Inc., "How Much Broadcast and Multicast Traffic Should I Allow in My Network," PowerConnect Application Note #5, Nov. 2003.

Toskala, Antti, "Enhancement of Broadcast and Introduction of Multicast Capabilities in RAN," Nokia Networks, Palm Springs, California, Mar. 13-16, 2001.

Microsoft Corporation, "IEEE 802.11 Networks and Windows XP," Windows Hardware Developer Central, Dec. 4, 2001.

Festag, Andreas, "What is MOMBASA?" Telecommunication Networks Group (TKN), Technical University of Berlin, Mar. 7, 2002.
Hewlett Packard, "HP ProCurve Networking: Enterprise Wireless LAN Networking and Mobility Solutions," 2003.
Dutta, Ashutosh et al., "MarconiNet Supporting Streaming Media Over Localized Wireless Multicast," Proc. of the 2d Int'l Workshop on Mobile Commerce, 2002.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
Cisco Systems, "Cisco Aironet Access Point Software Configuration Guide: Configuring Filters and Quality of Service," Aug. 2003.
Hirayama, Koji et al., "Next-Generation Mobile-Access IP Network," Hitachi Review vol. 49, No. 4, 2000.
Pat Calhoun et al., "802.11r strengthens wireless voice," Technology Update, Network World, Aug. 22, 2005, http://www.networkworld.com/news/tech/2005/082208techupdate.html.
Areg Alimian et al., "Analysis of Roaming Techniques," doc.:IEEE 802.11-04/0377r1, Submission, Mar. 2004.
Information Society Technologies Ultrawaves, "System Concept / Architecture Design and Communication Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias et al., "Transmit Antenna Diversity in Ricean Fading MIMO Channels with Co-Channel Interference," 2001.
Steger, Christopher et al., "Performance of IEEE 802.11b Wireless LAN in an Emulated Mobile Channel," 2003.
Chang, Nicholas B. et al., "Optimal Channel Probing and Transmission Scheduling for Opportunistics Spectrum Access," Sep. 2007.
Tsunekawa, Kouichi, "Diversity Antennas for Portable Telephones," 39th IEEE Vehicular Technology Conference, pp. 50-56, vol. I, Gateway to New Concepts in Vehicular Technology, May 1-3, 1989, San Francisco, CA.
Supplementary European Search Report for foreign application No. EP07755519 dated Mar. 11, 2009.
Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
W.E. Doherty, Jr. et al., The Pin Diode Circuit Designer's Handbook (1998).
Varnes et al., A Switched Radial Divider for an L-Band Mobile Satellite Antenna, European Microwave Conference (Oct. 1995), pp. 1037-1041.
English Translation of PCT Pub. No. WO2004/051798 (as filed U.S. Appl. No. 10/536,547).
Behdad et al., Slot Antenna Miniaturization Using Distributed Inductive Loading, Antenna and Propagation Society International Symposium, 2003 IEEE, vol. 1, pp. 308-311 (Jun. 2003).
Press Release, Netgear RangeMax(TM) Wireless Networking Solutions Incorporate Smart MIMO Technology To Eliminate Wireless Dead Spots and Take Consumers Farther, Ruckus Wireles Inc. (Mar. 7, 2005), available at http://ruckuswireless.com/press/releases/20050307.php.
Ando et al., "Study of Dual-Polarized Omni-Directional Antennas for 5.2 GHz-Band 2x2 MIMO-OFDM Systems," Antennas and Propogation Society International Symposium, 2004, IEEE, pp. 1740-1743 vol. 2.
Bedell, Paul, "Wireless Crash Course," 2005, p. 84, The McGraw-Hill Companies, Inc., USA.
Petition Decision Denying Request to Order Additional Claims for U.S. Patent No. 7,193,562 (Control No. 95/001078) mailed on Jul. 10, 2009.
Right of Appeal Notice for U.S. Patent No. 7,193,562 (Control No. 95/001078) mailed on Jul. 10, 2009.

* cited by examiner

MULTIBAND OMNIDIRECTIONAL PLANAR ANTENNA APPARATUS WITH SELECTABLE ELEMENTS

CROSS-REFERENCE TO RELATED APPLICATIONS

This application is a continuation-in-part of U.S. patent application Ser. No. 11/010,076, entitled "System and Method for an Omnidirectional Planar Antenna Apparatus with Selectable Elements," filed Dec. 9, 2004 now U.S. Pat. No. 7,292,198, which claims the benefit of U.S. Provisional Application No. 60/602,711 titled "Planar Antenna Apparatus for Isotropic Coverage and QoS Optimization in Wireless Networks," filed Aug. 18, 2004, and U.S. Provisional Application No. 60/603,157 titled "Software for Controlling a Planar Antenna Apparatus for Isotropic Coverage and QoS Optimization in Wireless Networks," filed Aug. 18, 2004, which are hereby incorporated by reference. This application is related to and incorporates by reference co-pending U.S. application Ser. No. 11/190,288 titled "Wireless System Having Multiple Antennas and Multiple Radios" filed Jul. 26, 2005.

BACKGROUND OF INVENTION

1. Field of the Invention

The present invention relates generally to wireless communications networks, and more particularly to a multiband omnidirectional planar antenna apparatus with selectable elements.

2. Description of the Prior Art

In communications systems, there is an ever-increasing demand for higher data throughput, and a corresponding drive to reduce interference that can disrupt data communications. For example, in an IEEE 802.11 network, an access point (i.e., base station) communicates data with one or more remote receiving nodes (e.g., a network interface card) over a wireless link. The wireless link may be susceptible to interference from other access points, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One solution for reducing interference in the wireless link between the access point and the remote receiving node is to provide several omnidirectional antennas for the access point, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space, additionally, most of the laptop computer wireless cards have horizontally polarized antennas. Typical solutions for creating horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another solution to reduce interference involves beam steering with an electronically controlled phased array antenna. However, the phased array antenna can be extremely expensive to manufacture. Further, the phased array antenna can require many phase tuning elements that may drift or otherwise become maladjusted.

Further, incorporating multiple band coverage into an access point having one or more omnidirectional antennas is not a trivial task. Typically, antennas operate well at one frequency band but are inoperable or give suboptimal performance at another frequency band. Providing multiple band coverage into an access point may require a large number of antennas, each tuned to operate at different frequencies.

The large number of antennas can make the access point appear as an unsightly "antenna farm." The antenna farm is particularly unsuitable for home consumer applications because large numbers of antennas with necessary separation can require an increase in the overall size of the access point, which most consumers desire to be as small and unobtrusive as possible.

SUMMARY OF INVENTION

In one aspect, an antenna apparatus comprises a substrate having a first layer and a second layer. An antenna element on the first layer includes a first dipole component configured to radiate at a first radio frequency (e.g., a low band of about 2.4 to 2.4835 GHz) and a second dipole component configured to radiate at a second radio frequency (e.g., a high band of about 4.9 to 5.825 GHz). A ground component on the second layer includes a corresponding portion of the first dipole component and a corresponding portion of the second dipole component.

The antenna apparatus may include a plurality of the antenna elements and an antenna element selector coupled to the plurality of antenna elements. The antenna element selector is configured to selectively couple the antenna elements to a communication device for generating the first radio frequency and the second radio frequency. The antenna element selector may comprise a PIN diode network. The antenna element selector may be configured to simultaneously couple a first group of the plurality of antenna elements to the first radio frequency and a second group of the plurality of antenna elements to the second radio frequency In one aspect, a method comprises generating low band RF, generating high band RF, coupling the low band RF to a first group of a plurality of planar antenna elements, and coupling the high band RF to a second group of the plurality of planar antenna elements. The first group may include none, or one or more of the antenna elements included in the second group of antenna elements. The first group of antenna elements may be configured to radiate at a different orientation with respect to the second group of antenna elements, or may be configured to radiate at about the same orientation with respect to the second group of antenna elements.

In one aspect, a multiband coupling network comprises a feed port configured to receive low band RF or high band RF, a first filter configured to pass the low band RF and shift the low band RF by a predetermined delay, and a second filter in parallel with the first filter. The second filter is configured to pass the high band RF and shift the high band RF by the predetermined delay.

The predetermined delay may comprise ¼-wavelength or odd multiples thereof. The multiband coupling network may comprise an RF switch network configured to selectively couple the feed port to the first filter or the second filter. The multiband coupling network may comprise a first PIN diode network configured to selectively couple the feed port to the first filter and a second PIN diode network configured to selectively couple the feed port to the second filter.

In one aspect, a multiband coupling network comprises a feed port configured to receive low band RF or high band RF, a first switch coupled to the feed port, a second switch coupled to the feed port, a first set of coupled lines (e.g., meandered traces) coupled to the first switch and configured to pass the low band RF, and a second set of coupled lines coupled to the second switch and configured to pass the high band RF. The first switch and the first set of coupled lines may comprise ¼-wavelength of delay for the low band RF and the second switch and the second set of coupled lines may comprise ¼-wavelength of delay for the high band RF.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

A system for a wireless (i.e., radio frequency or RF) link to a remote receiving device includes a communication device for generating an RF signal and a planar antenna apparatus for transmitting and/or receiving the RF signal. The planar antenna apparatus includes selectable antenna elements. Each of the antenna elements provides gain (with respect to isotropic) and a directional radiation pattern substantially in the plane of the antenna elements. Each antenna element may be electrically selected (e.g., switched on or off) so that the planar antenna apparatus may form a configurable radiation pattern. If all elements are switched on, the planar antenna apparatus forms an omnidirectional radiation pattern. In some embodiments, if two or more of the elements is switched on, the planar antenna apparatus may form a substantially omnidirectional radiation pattern.

Advantageously, the system may select a particular configuration of selected antenna elements that minimizes interference over the wireless link to the remote receiving device. If the wireless link experiences interference, for example due to other radio transmitting devices, or changes or disturbances in the wireless link between the system and the remote receiving device, the system may select a different configuration of selected antenna elements to change the resulting radiation pattern and minimize the interference. The system may select a configuration of selected antenna elements corresponding to a maximum gain between the system and the remote receiving device. Alternatively, the system may select a configuration of selected antenna elements corresponding to less than maximal gain, but corresponding to reduced interference in the wireless link.

As described further herein, the planar antenna apparatus radiates the directional radiation pattern substantially in the plane of the antenna elements. When mounted horizontally, the RF signal transmission is horizontally polarized, so that RF signal transmission indoors is enhanced as compared to a vertically polarized antenna. The planar antenna apparatus is easily manufactured from common planar substrates such as an FR4 printed circuit board (PCB). Further, the planar antenna apparatus may be integrated into or conformally mounted to a housing of the system, to minimize cost and to provide support for the planar antenna apparatus.

Figure 1:
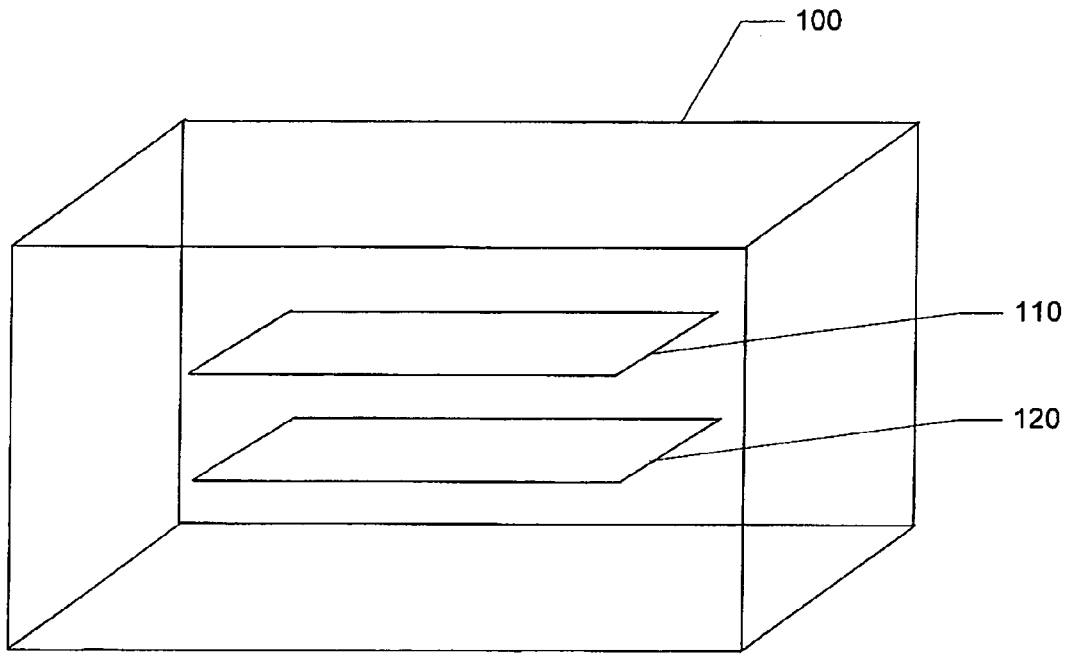
FIG. 1 illustrates a system comprising an omnidirectional planar antenna apparatus with selectable elements, in one embodiment in accordance with the present invention.

FIG. 1 illustrates a system 100 comprising an omnidirectional planar antenna apparatus with selectable elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, and a remote terminal such as a handheld gaming device. In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the planar antenna apparatus, the system 100 may also receive data from the remote receiving node via the planar antenna apparatus.

The system 100 includes a communication device 120 (e.g., a transceiver) and a planar antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, for example, the communication device 120 comprises well-known circuitry for receiving data packets of video from the router and circuitry for converting the data packets into 802.11 compliant RF signals.

As described further herein, the planar antenna apparatus 110 comprises a plurality of individually selectable planar antenna elements. Each of the antenna elements has a directional radiation pattern with gain (as compared to an omnidirectional antenna). Each of the antenna elements also has a polarization substantially in the plane of the planar antenna apparatus 110. The planar antenna apparatus 110 may include an antenna element selecting device configured to selectively couple one or more of the antenna elements to the communication device 120.

Figure 2A:
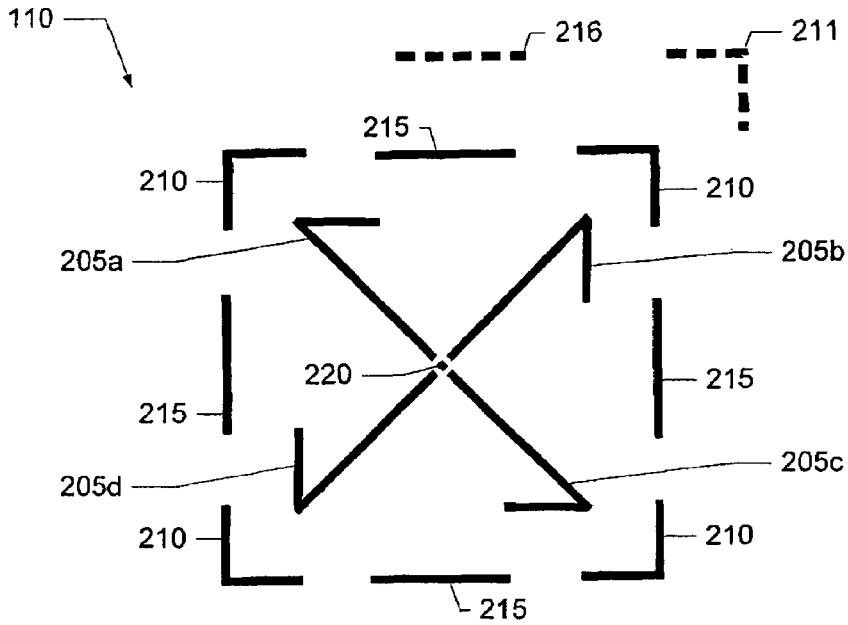
FIG. 2A and FIG. 2B illustrate the planar antenna apparatus of FIG. 1, in one embodiment in accordance with the present invention.
Figure 2B:
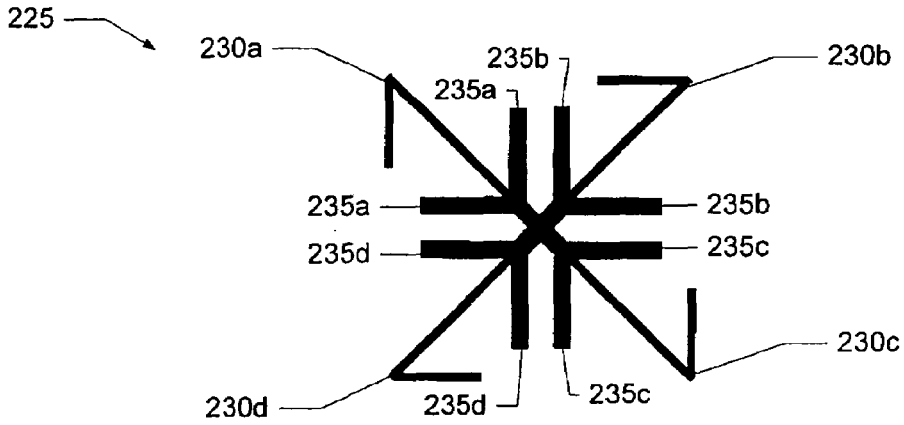

FIG. 2A and FIG. 2B illustrate the planar antenna apparatus 110 of FIG. 1, in one embodiment in accordance with the present invention. The planar antenna apparatus 110 of this embodiment includes a substrate (considered as the plane of FIGS. 2A and 2B) having a first side (e.g., FIG. 2A) and a second side (e.g., FIG. 2B) substantially parallel to the first side. In some embodiments, the substrate comprises a PCB such as FR4, Rogers 4003, or other dielectric material.

On the first side of the substrate, the planar antenna apparatus 110 of FIG. 2A includes a radio frequency feed port 220 and four antenna elements 205*a*-205*d*. As described with respect to FIG. 4, although four antenna elements are depicted, more or fewer antenna elements are contemplated. Although the antenna elements 205*a*-205*d* of FIG. 2A are oriented substantially on diagonals of a square shaped planar antenna so as to minimize the size of the planar antenna apparatus 110, other shapes are contemplated. Further, although the antenna elements 205*a*-205*d* form a radially symmetrical layout about the radio frequency feed port 220, a number of non-symmetrical layouts, rectangular layouts, and layouts symmetrical in only one axis, are contemplated. Furthermore, the antenna elements 205*a*-205*d* need not be of identical dimension, although depicted as such in FIG. 2A.

On the second side of the substrate, as shown in FIG. 2B, the planar antenna apparatus 110 includes a ground component 225. It will be appreciated that a portion (e.g., the portion 230*a*) of the ground component 225 is configured to form an arrow-shaped bent dipole in conjunction with the antenna element 205*a*. The resultant bent dipole provides a directional radiation pattern substantially in the plane of the planar antenna apparatus 110, as described further with respect to FIG. 3.

Figure 2C:
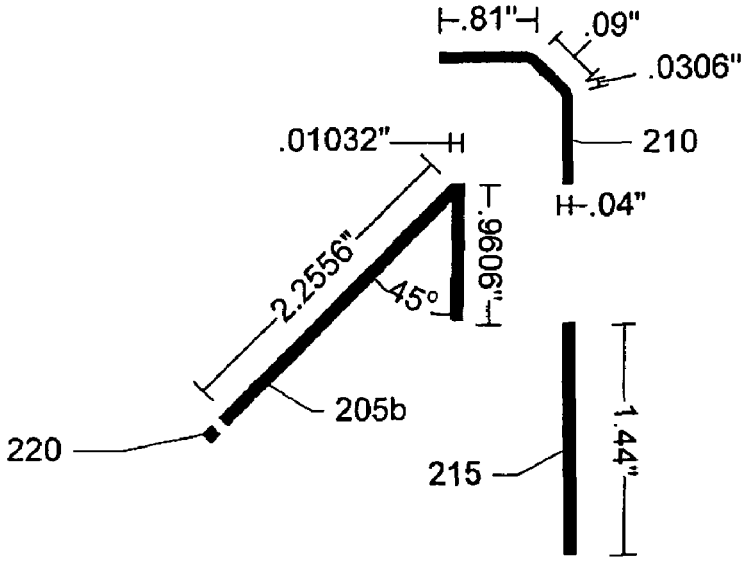
FIGS. 2C and 2D (collectively with FIGS. 2A and 2B referred to as FIG. 2) illustrate dimensions for several components of the planar antenna apparatus of FIG. 1, in one embodiment in accordance with the present invention.
Figure 2D:
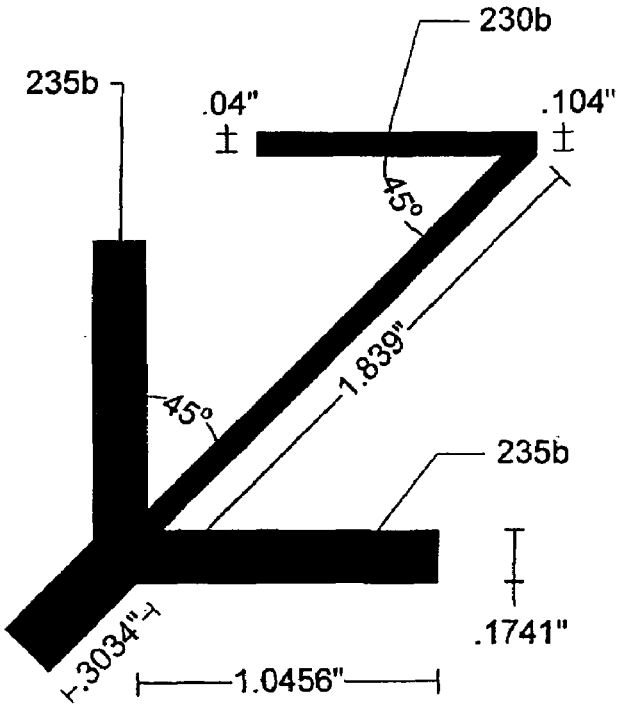

FIGS. 2C and 2D illustrate dimensions for several components of the planar antenna apparatus 110, in one embodiment in accordance with the present invention. It will be appreciated that the dimensions of the individual components of the planar antenna apparatus 110 (e.g., the antenna element 205*a*, the portion 230*a* of the ground component 205) depend upon a desired operating frequency of the planar antenna apparatus 110. The dimensions of the individual components may be established by use of RF simulation software, such as IE3D from Zeland Software of Fremont, Calif. For example, the planar antenna apparatus 110 incorporating the components of dimension according to FIGS. 2C and 2D is designed for operation near 2.4 GHz, based on a substrate PCB of Rogers 4003 material, but it will be appreciated by an antenna designer of ordinary skill that a different substrate having different dielectric properties, such as FR4, may require different dimensions than those shown in FIGS. 2C and 2D.

As shown in FIG. 2, the planar antenna apparatus 110 may optionally include one or more directors 210, one or more gain directors 215, and/or one or more Y-shaped reflectors 235 (e.g., the Y-shaped reflector 235*b* depicted in FIGS. 2B and 2D). The directors 210, the gain directors 215, and the Y-shaped reflectors 235 comprise passive elements that concentrate the directional radiation pattern of the dipoles formed by the antenna elements 205*a*-205*d* in conjunction with the portions 230*a*-230*d*. In one embodiment, providing a director 210 for each antenna element 205*a*-205*d* yields an additional 1-2 dB of gain for each dipole. It will be appreciated that the directors 210 and/or the gain directors 215 may be placed on either side of the substrate. In some embodiments, the portion of the substrate for the directors 210 and/or gain directors 215 is scored so that the directors 210 and/or gain directors 215 may be removed. It will also be appreciated that additional directors (depicted in a position shown by dashed line 211 for the antenna element 205*b*) and/or additional gain directors (depicted in a position shown by a dashed line 216) may be included to further concentrate the directional radiation pattern of one or more of the dipoles. The Y-shaped reflectors 235 will be further described herein.

The radio frequency feed port 220 is configured to receive an RF signal from and/or transmit an RF signal to the communication device 120 of FIG. 1. An antenna element selector (not shown) may be used to couple the radio frequency feed port 220 to one or more of the antenna elements 205*a*-205*d*. The antenna element selector may comprise an RF switch (not shown), such as a PIN diode, a GaAs FET, or virtually any RF switching device, as is well known in the art.

In the embodiment of FIG. 2A, the antenna element selector comprises four PIN diodes, each PIN diode connecting one of the antenna elements 205*a*-205*d* to the radio frequency feed port 220. In this embodiment, the PIN diode comprises a single-pole single-throw switch to switch each antenna element either on or off (i.e., couple or decouple each of the antenna elements 205*a*-205*d* to the radio frequency feed port 220). In one embodiment, a series of control signals (not shown) is used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 220 and the PIN diodes of the antenna element selector are on the side of the substrate with the antenna elements 205*a*-205*d*, however, other embodiments separate the radio frequency feed port 220, the antenna element selector, and the antenna elements 205*a*-205*d*. In some embodiments, the antenna element selector comprises one or more single-pole multiple-throw switches. In some embodiments, one or more light emitting diodes (not shown) are coupled to the antenna element selector as a visual indicator of which of the antenna elements 205*a*-205*d* is on or off. In one embodiment, a light emitting diode is placed in circuit with the PIN diode so that the light emitting diode is lit when the corresponding antenna element 205 is selected.

In some embodiments, the antenna components (e.g., the antenna elements 205*a*-205*d*, the ground component 225, the directors 210, and the gain directors 215) are formed from RF conductive material. For example, the antenna elements 205*a*-205*d* and the ground component 225 may be formed from metal or other RF conducting foil. Rather than being provided on opposing sides of the substrate as shown in FIGS. 2A and 2B, each antenna element 205*a*-205*d* is coplanar with the ground component 225. In some embodiments, the antenna components may be conformally mounted to the housing of the system 100. In such embodiments, the antenna element selector comprises a separate structure (not shown) from the antenna elements 205*a*-205*d*. The antenna element selector may be mounted on a relatively small PCB, and the PCB may be electrically coupled to the antenna elements 205*a*-205*d*. In some embodiments, the switch PCB is soldered directly to the antenna elements 205*a*-205*d*.

In the embodiment of FIG. 2B, the Y-shaped reflectors 235 (e.g., the reflectors 235*a*) may be included as a portion of the ground component 225 to broaden a frequency response (i.e., bandwidth) of the bent dipole (e.g., the antenna element 205*a* in conjunction with the portion 230*a* of the ground component 225). For example, in some embodiments, the planar antenna apparatus 110 is designed to operate over a frequency range of about 2.4 GHz to 2.4835 GHz, for wireless LAN in accordance with the IEEE 802.11 standard. The reflectors 235*a*-235*d* broaden the frequency response of each dipole to about 300 MHz (12.5% of the center frequency) to 500 MHz (~20% of the center frequency). The combined operational bandwidth of the planar antenna apparatus 110 resulting from coupling more than one of the antenna elements 205*a*-205*d* to the radio frequency feed port 220 is less than the bandwidth resulting from coupling only one of the antenna elements 205*a*-205*d* to the radio frequency feed port 220. For example, with all four antenna elements 205*a*-205*d* selected to result in an omnidirectional radiation pattern, the combined frequency response of the planar antenna apparatus 110 is about 90 MHz. In some embodiments, coupling more than one of the antenna elements 205*a*-205*d* to the radio frequency feed port 220 maintains a match with less than 10 dB return loss over 802.11 wireless LAN frequencies, regardless of the number of antenna elements 205*a*-205*d* that are switched on.

Figure 3A:
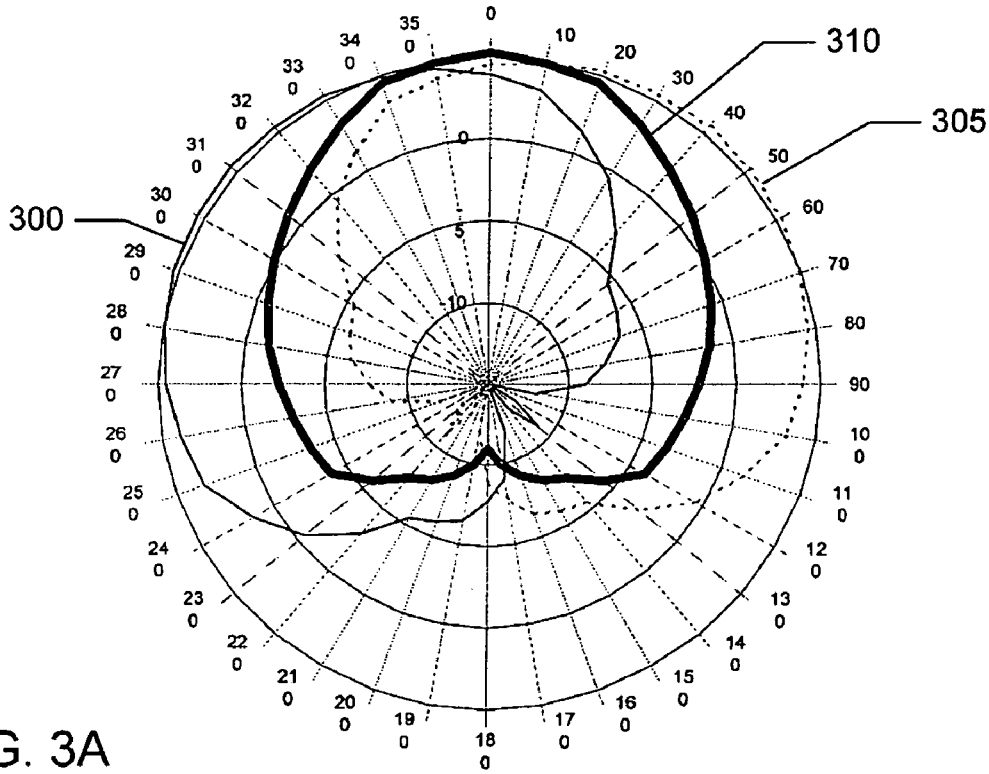
FIG. 3A illustrates various radiation patterns resulting from selecting different antenna elements of the planar antenna apparatus of FIG. 2, in one embodiment in accordance with the present invention.

FIG. 3A illustrates various radiation patterns resulting from selecting different antenna elements of the planar antenna apparatus 110 of FIG. 2, in one embodiment in accordance with the present invention. FIG. 3A depicts the radiation pattern in azimuth (e.g., substantially in the plane of the substrate of FIG. 2). A line 300 displays a generally cardioid directional radiation pattern resulting from selecting a single antenna element (e.g., the antenna element 205*a*). As shown, the antenna element 205*a* alone yields approximately 5 dBi of gain. A dashed line 305 displays a similar directional radiation pattern, offset by approximately 90 degrees, resulting from selecting an adjacent antenna element (e.g., the antenna element 205*b*). A line 310 displays a combined radiation pattern resulting from selecting the two adjacent antenna elements 205*a* and 205*b*. In this embodiment, enabling the two adjacent antenna elements 205*a* and 205*b* results in higher directionality in azimuth as compared to selecting either of the antenna elements 205*a* or 205*b* alone, with approximately 5.6 dBi gain.

The radiation pattern of FIG. 3A in azimuth illustrates how the selectable antenna elements 205*a*-205*d* may be combined to result in various radiation patterns for the planar antenna apparatus 110. As shown, the combined radiation pattern resulting from two or more adjacent antenna elements (e.g., the antenna element 205*a* and the antenna element 205*b*) being coupled to the radio frequency feed port is more directional than the radiation pattern of a single antenna element.

Not shown in FIG. 3A for improved legibility, is that the selectable antenna elements 205*a*-205*d* may be combined to result in a combined radiation pattern that is less directional than the radiation pattern of a single antenna element. For example, selecting all of the antenna elements 205*a*-205*d* results in a substantially omnidirectional radiation pattern that has less directionality than that of a single antenna element. Similarly, selecting two or more antenna elements (e.g., the antenna element 205*a* and the antenna element 205*c* on opposite diagonals of the substrate) may result in a substantially omnidirectional radiation pattern. In this fashion, selecting a subset of the antenna elements 205*a*-205*d*, or substantially all of the antenna elements 205*a*-205*d*, may result in a substantially omnidirectional radiation pattern for the planar antenna apparatus 110.

Although not shown in FIG. 3A, it will be appreciated that additional directors (e.g., the directors 211) and/or gain directors (e.g., the gain directors 216) may further concentrate the directional radiation pattern of one or more of the antenna elements 205*a*-205*d* in azimuth. Conversely, removing or eliminating one or more of the directors 211, the gain directors 216, or the Y-shaped reflectors 235 expands the directional radiation pattern of one or more of the antenna elements 205*a*-205*d* in azimuth.

FIG. 3A also shows how the planar antenna apparatus 110 may be advantageously configured, for example, to reduce interference in the wireless link between the system 100 of FIG. 1 and a remote receiving node. For example, if the remote receiving node is situated at zero degrees in azimuth relative to the system 100 (at the center of FIG. 3A), the antenna element 205*a* corresponding to the line 300 yields approximately the same gain in the direction of the remote receiving node as the antenna element 205*b* corresponding to the line 305. However, as can be seen by comparing the line 300 and the line 305, if an interferer is situated at twenty degrees of azimuth relative to the system 100, selecting the antenna element 205*a* yields approximately a 4 dB signal strength reduction for the interferer as opposed to selecting the antenna element 205*b*. Advantageously, depending on the signal environment around the system 100, the planar antenna apparatus 110 may be configured (e.g., by switching one or more of the antenna elements 205*a*-205*d* on or off) to reduce interference in the wireless link between the system 100 and one or more remote receiving nodes.

Figure 3B:
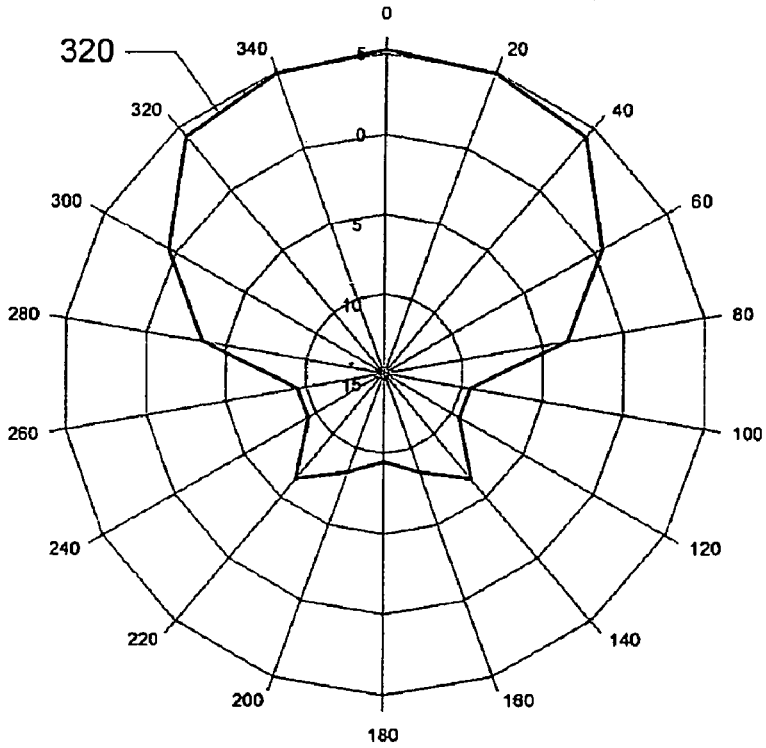
FIG. 3B (collectively with FIG. 3A referred to as FIG. 3) illustrates an elevation radiation pattern for the planar antenna apparatus of FIG. 2, in one embodiment in accordance with the present invention.

FIG. 3B illustrates an elevation radiation pattern for the planar antenna apparatus 110 of FIG. 2. In the figure, the plane of the planar antenna apparatus 110 corresponds to a line from 0 to 180 degrees in the figure. Although not shown, it will be appreciated that additional directors (e.g., the directors 211) and/or gain directors (e.g., the gain directors 216) may advantageously further concentrate the radiation pattern of one or more of the antenna elements 205*a*-205*d* in elevation. For example, in some embodiments, the system 110 may be located on a floor of a building to establish a wireless local area network with one or more remote receiving nodes on the same floor. Including the additional directors 211 and/or gain directors 216 in the planar antenna apparatus 110 further concentrates the wireless link to substantially the same floor, and minimizes interference from RF sources on other floors of the building.

Figure 4A:
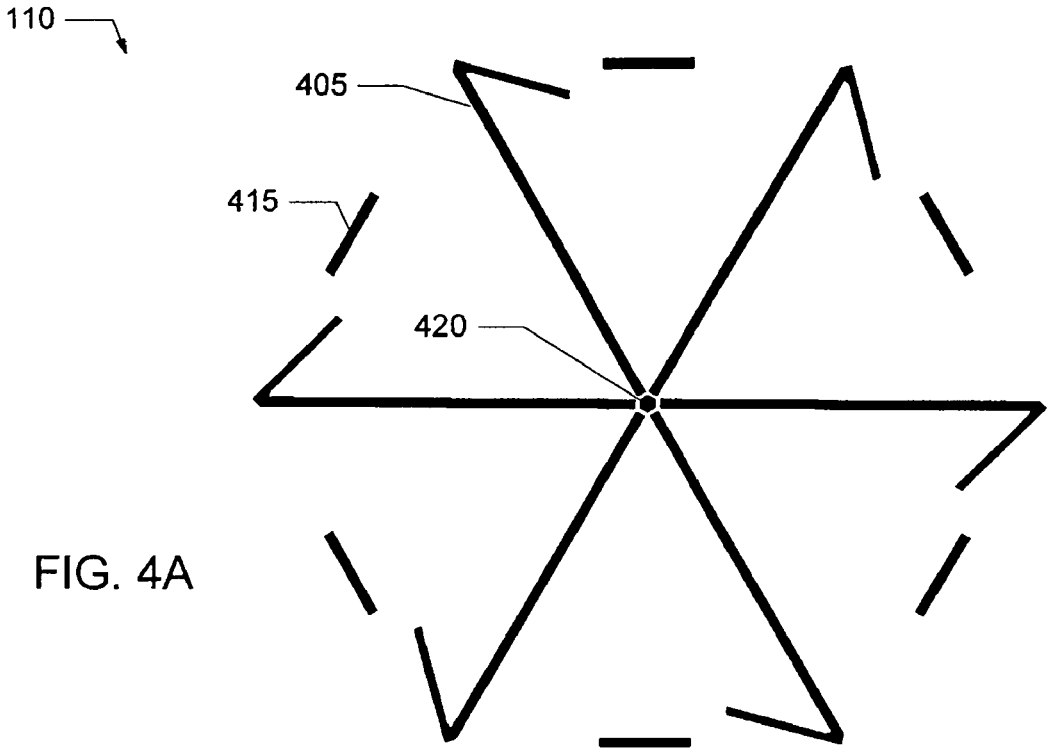
FIG. 4A and FIG. 4B (collectively referred to as FIG. 4) illustrate an alternative embodiment of the planar antenna apparatus 110 of FIG. 1, in accordance with the present invention.
Figure 4B:
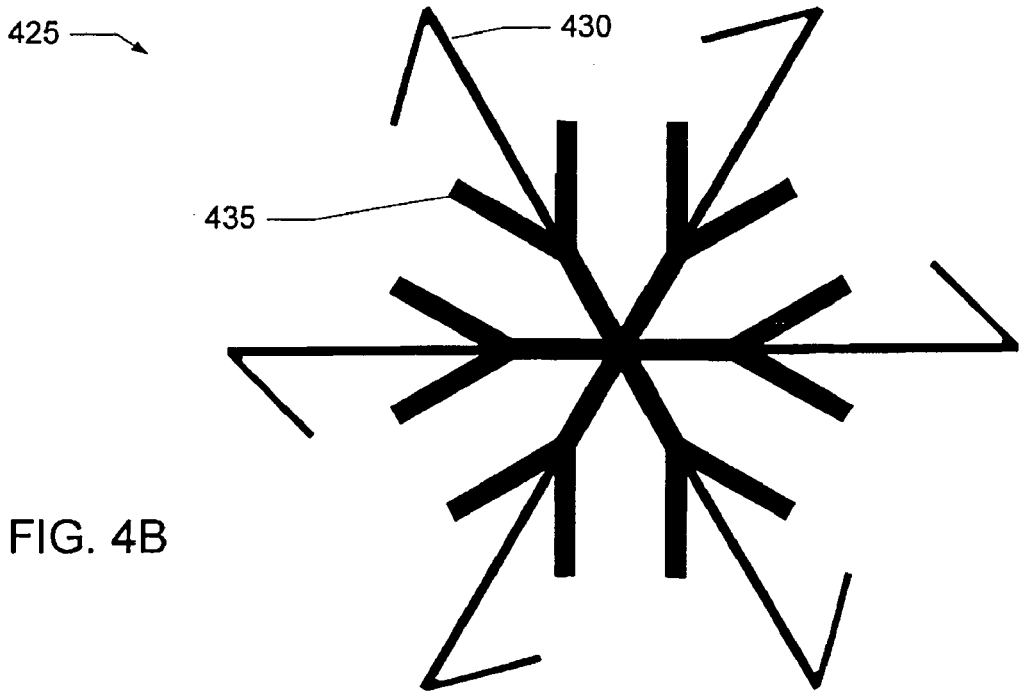

FIG. 4A and FIG. 4B illustrate an alternative embodiment of the planar antenna apparatus 110 of FIG. 1, in accordance with the present invention. On the first side of the substrate as shown in FIG. 4A, the planar antenna apparatus 110 includes a radio frequency feed port 420 and six antenna elements (e.g., the antenna element 405). On the second side of the substrate, as shown in FIG. 4B, the planar antenna apparatus 110 includes a ground component 425 incorporating a number of Y-shaped reflectors 435. It will be appreciated that a portion (e.g., the portion 430) of the ground component 425 is configured to form an arrow-shaped bent dipole in conjunction with the antenna element 405. Similarly to the embodiment of FIG. 2, the resultant bent dipole has a directional radiation pattern. However, in contrast to the embodiment of FIG. 2, the six antenna element embodiment provides a larger number of possible combined radiation patterns.

Similarly with respect to FIG. 2, the planar antenna apparatus 110 of FIG. 4 may optionally include one or more directors (not shown) and/or one or more gain directors 415. The directors and the gain directors 415 comprise passive elements that concentrate the directional radiation pattern of the antenna elements 405. In one embodiment, providing a director for each antenna element yields an additional 1-2 dB of gain for each element. It will be appreciated that the directors and/or the gain directors 415 may be placed on either side of the substrate. It will also be appreciated that additional directors and/or gain directors may be included to further concentrate the directional radiation pattern of one or more of the antenna elements 405.

An advantage of the planar antenna apparatus 110 of FIGS. 2-4 is that the antenna elements (e.g., the antenna elements 205*a*-205*d*) are each selectable and may be switched on or off to form various combined radiation patterns for the planar antenna apparatus 110. For example, the system 100 communicating over the wireless link to the remote receiving node may select a particular configuration of selected antenna elements that minimizes interference over the wireless link. If the wireless link experiences interference, for example due to other radio transmitting devices, or changes or disturbances in the wireless link between the system 100 and the remote receiving node, the system 100 may select a different configuration of selected antenna elements to change the radiation pattern of the planar antenna apparatus 110 and minimize the interference in the wireless link. The system 100 may select a configuration of selected antenna elements corresponding to a maximum gain between the system and the remote receiving node. Alternatively, the system may select a configuration of selected antenna elements corresponding to less than maximal gain, but corresponding to reduced interference. Alternatively, all or substantially all of the antenna elements may be selected to form a combined omnidirectional radiation pattern.

A further advantage of the planar antenna apparatus 110 is that RF signals travel better indoors with horizontally polarized signals. Typically, network interface cards (NICs) are horizontally polarized. Providing horizontally polarized signals with the planar antenna apparatus 110 improves interference rejection (potentially, up to 20 dB) from RF sources that use commonly-available vertically polarized antennas.

Another advantage of the system 100 is that the planar antenna apparatus 110 includes switching at RF as opposed to switching at baseband. Switching at RF means that the communication device 120 requires only one RF up/down converter. Switching at RF also requires a significantly simplified interface between the communication device 120 and the planar antenna apparatus 110. For example, the planar antenna apparatus provides an impedance match under all configurations of selected antenna elements, regardless of which antenna elements are selected. In one embodiment, a match with less than 10 dB return loss is maintained under all configurations of selected antenna elements, over the range of frequencies of the 802.11 standard, regardless of which antenna elements are selected.

A still further advantage of the system 100 is that, in comparison for example to a phased array antenna with relatively complex phase switching elements, switching for the planar antenna apparatus 110 is performed to form the combined radiation pattern by merely switching antenna elements on or off. No phase variation, with attendant phase matching complexity, is required in the planar antenna apparatus 110.

Yet another advantage of the planar antenna apparatus 110 on PCB is that the planar antenna apparatus 110 does not require a 3-dimensional manufactured structure, as would be required by a plurality of "patch" antennas needed to form an omnidirectional antenna. Another advantage is that the planar antenna apparatus 110 may be constructed on PCB so that the entire planar antenna apparatus 110 can be easily manufactured at low cost. One embodiment or layout of the planar antenna apparatus 110 comprises a square or rectangular shape, so that the planar antenna apparatus 10 is easily panelized.

Multiband Antenna Apparatus

Figure 5:
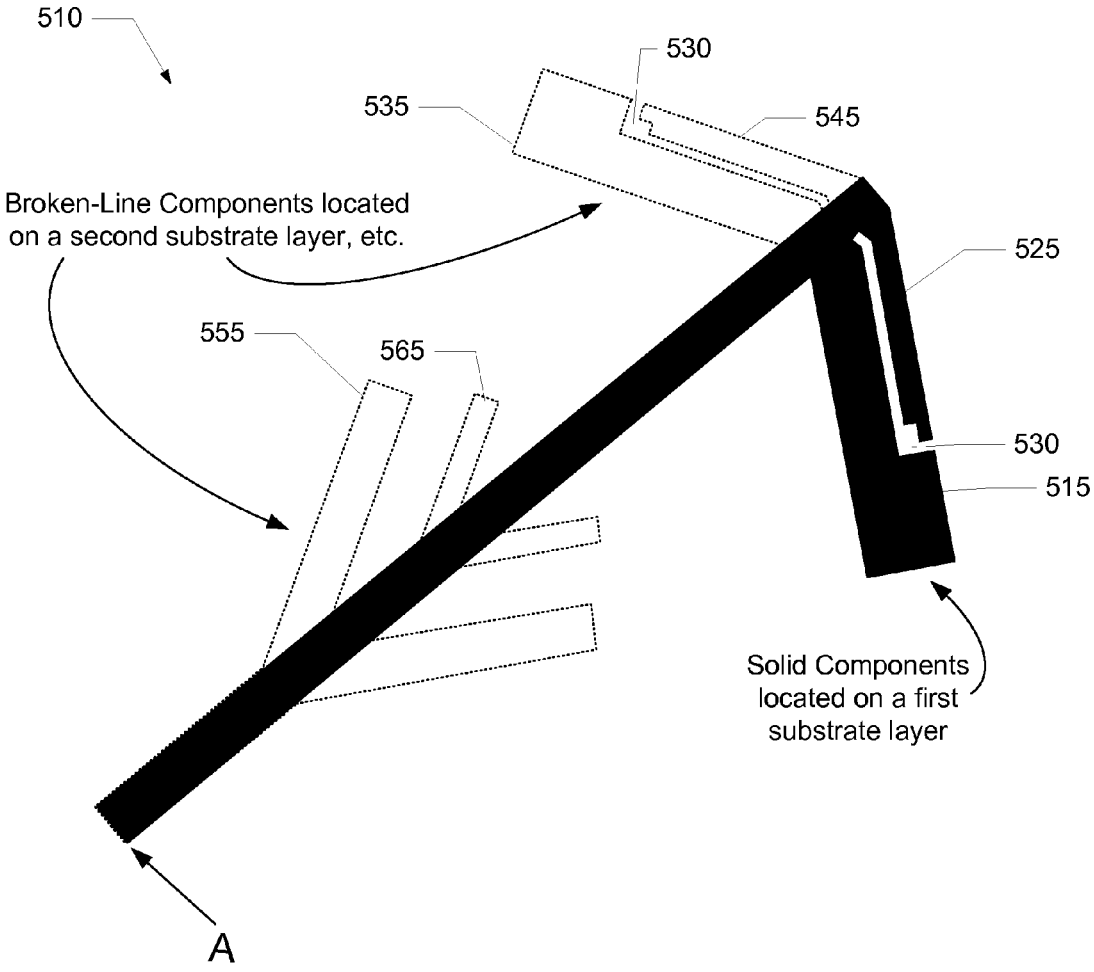
FIG. 5 illustrates one element of a multiband antenna element for use in the planar antenna apparatus of FIG. 1, in one embodiment in accordance with the present invention.

FIG. 5 illustrates one element of a multiband antenna element 510 for use in the planar antenna apparatus 110 of FIG. 1, in one embodiment in accordance with the present invention. In embodiments for multiband operation (e.g., dual-band with low band and high band, tri-band with low band, mid band, and high band, and the like), the communication device 120 comprises a "multiband" device that has the ability to generate and/or receive an RF signal at more than one band of frequencies.

As described further herein, in some embodiments (e.g., for a network interface card or NIC), the communication device 120 operates (e.g., for 802.11) alternatively at a low band of about 2.4 to 2.4835 GHz or at a high band of about 4.9 to 5.35 GHz and/or 5.725 to 5.825 GHz, and switches between the bands at a relatively low rate on the order of minutes or days. The multiband antenna elements 510 and multiband coupling network of FIGS. 6-8 allow the NIC to operate on a configuration of selected antenna elements 510. For example, the NIC may transmit low band RF in a directional or omnidirectional pattern by selecting a group of one or more multiband antenna elements 510.

In some embodiments, such as in an access point for 802.11, the communication device 120 switches between the bands at a relatively high rate (e.g., changing from the low band to the high band for each packet to be transmitted, such that milliseconds are required for switching). For example, the access point may transmit a first packet to a receiving node with low band RF on a first configuration of selected multiband antenna elements 510 (directional or omnidirectional pattern). The access point may then switch to a second configuration of selected multiband antenna elements 510 to transmit a second packet.

In still other embodiments, the multiband communication device 120 includes multiple MACs to allow simultaneous independent operation on multiple bands by independently-selectable multiband antenna elements 510. In simultaneous operation on multiple bands, the multiband communication device 120 may generate, for example, low and high band RF to improve data rate to a remote receiving node. With simultaneous multiband capability, the system 100 (FIG. 1) may send low band to a first remote receiving node via a first configuration (group) of selected multiband antenna elements 510 while simultaneously sending high band to a second remote receiving node via a second configuration (group) of selected multiband antenna elements 510. The first and second configurations or groups of selected multiband antenna elements 510 may be the same or different.

For ease of explanation of the multiband antenna element 510, only a single multiband antenna element 510 is shown in FIG. 5. The multiband antenna element 510 may be used in place of one or more of the antenna elements 205*a-d* and corresponding ground component 225 portions 230*a-d* and reflectors 235*a-d* of FIG. 2. Alternatively, the multiband antenna element 510 may be used in place of one or more of the antenna elements 405 and the ground component 425 portions 430 and reflectors 435 of FIG. 4. As described with respect to FIGS. 2 to 4, configurations other than the 4-element and 6-element configurations are contemplated.

In some embodiments, the multiband antenna element 510 includes a substrate (considered as the plane of FIG. 5) having two layers. In a preferred embodiment, the substrate has four layers, although the substrate may have any number of layers. FIG. 5 illustrates the multiband antenna element 510 as it would appear in an X-ray of the substrate.

In some embodiments, the substrate comprises a PCB such as FR4, Rogers 4003, or other dielectric material, with the multiband antenna element 510 formed from traces on the PCB. Although the remainder of the description will focus on the multiband antenna element 510 being formed on separate layers of a PCB, in some embodiments the multiband antenna element 510 is formed from RF-conductive material such that the components of the multiband antenna element 510 may be coplanar or on a single layer so that the antenna apparatus 110 may be conformally mounted, for example.

On the first layer of the substrate, depicted in solid lines (e.g., traces on the PCB), the multiband antenna element 510 includes a first dipole component 515 and a second dipole component 525. The second dipole component 525 is configured to form a dual resonance structure with the first dipole component 515. The dual resonance structure broadens the frequency response of the multiband antenna element 510.

Further, the second dipole component 525 may optionally include a notched-out or "step" structure 530. The step structure 530 further broadens the frequency response of the second dipole component 525. In some embodiments, the step structure 530 broadens the frequency response of the second dipole component 525 such that it can radiate in a broad range of frequencies from about 4.9 to 5.825 GHz.

On the second, third, and/or fourth layers of the substrate, the multiband antenna element 510 has a ground component, depicted in broken lines in FIG. 5. The ground component includes a corresponding portion 535 for the first dipole component 515 and a corresponding portion 545 for the second dipole component 525. As depicted in FIG. 5, the dipole components and corresponding portions of the ground component need not be 180 degrees opposite each other such that the dipole components form a "T," but the dipole components can be angled such that an arrow-head shape results. For example, the first dipole component 515 is at about a 120-degree angle with respect to the corresponding portion 535, for inclusion in a hexagonally-shaped substrate with six multiband antenna elements 510.

The ground component optionally includes a first reflector component 555 configured to concentrate the radiation pattern and broaden the frequency response (bandwidth) of the first dipole component 515 and corresponding portion 535. The ground component further includes a second reflector component 565 configured to concentrate the radiation pattern and broaden the frequency response (bandwidth) of the second dipole component 525 and corresponding portion 545.

Not shown in FIG. 5 are optional directors and/or gain directors oriented with respect to the multiband antenna element 510. Such passive elements, as described with respect to FIGS. 2 to 4, may be included on the substrate to concentrate the directional radiation pattern of the first dipole formed by the first dipole component 515 in conjunction with corresponding portion 535, and/or the second dipole formed by the second dipole component 525 in conjunction with corresponding portion 545.

Figure 6:
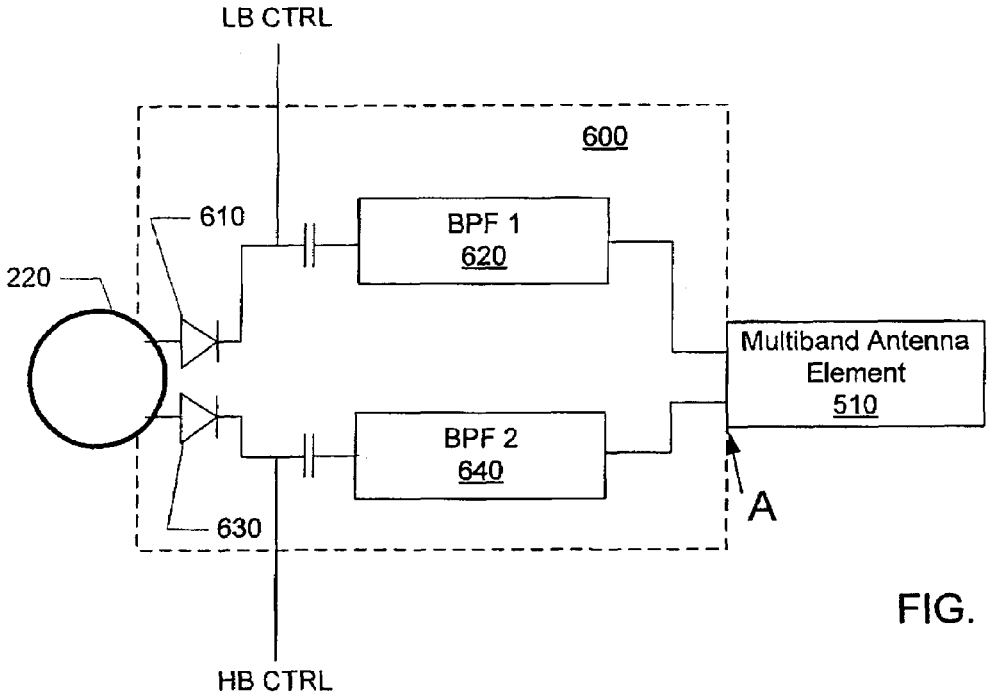
FIG. 6 illustrates a multiband coupling network for coupling the multiband antenna element of FIG. 5 to a multiband communication device of FIG. 1, in one embodiment in accordance with the present invention.
Figure 7:
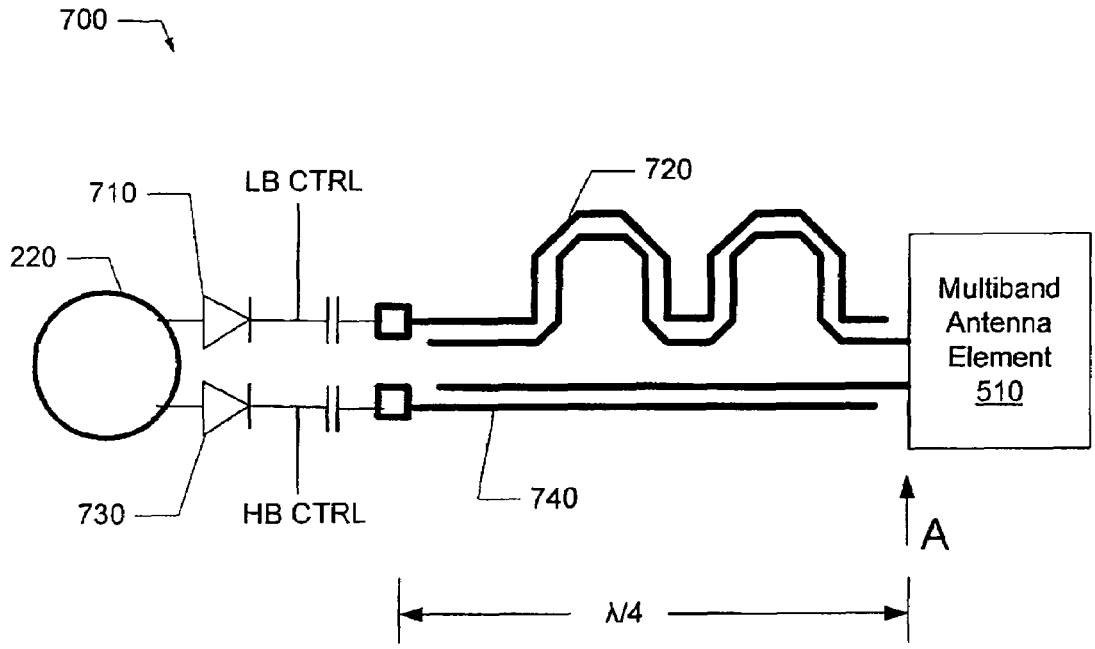
FIG. 7 illustrates an enlarged view of a partial PCB layout for a multiband coupling network between the multiband communication device of FIG. 1 and the multiband antenna element of FIG. 5, in one embodiment in accordance with the present invention.
Figure 8:
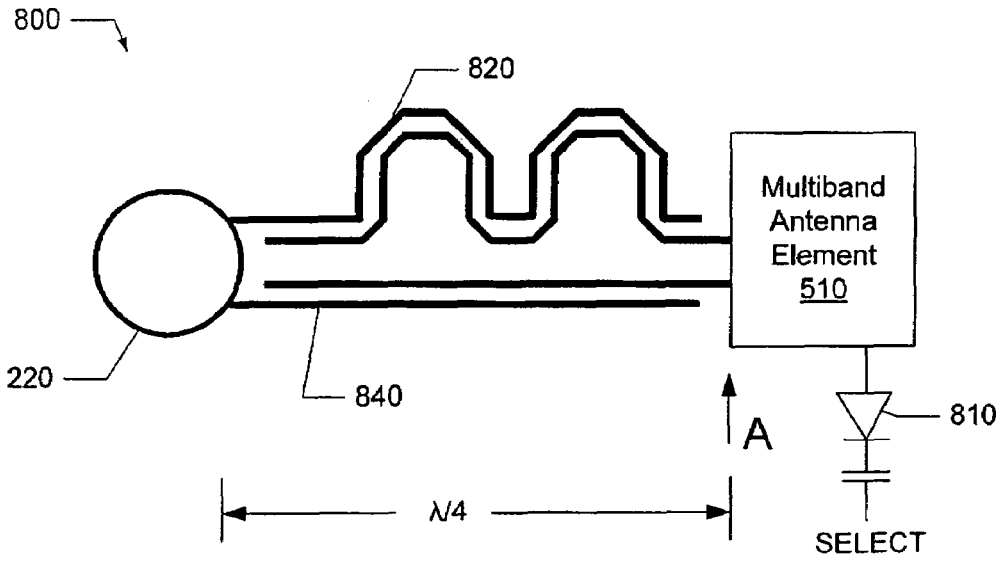
FIG. 8 illustrates an enlarged view of a partial PCB layout for a multiband coupling network between the multiband communication device of FIG. 1 and the multiband antenna element of FIG. 5, in one embodiment in accordance with the present invention.

In operation, low band and/or high band RF energy to/from the multiband communication device 120 is coupled via a multiband coupling network, described further with respect to FIGS. 6-8, into the point labeled "A" in FIG. 5. The first dipole component 515 and corresponding portion 535 are configured to radiate at a lower band first frequency of about 2.4 to 2.4835 GHz. The second dipole component 525 and corresponding portion 545 are configured to radiate at a second frequency. In some embodiments, the second frequency is in the range of about 4.9 to 5.35 GHz. In other embodiments, the second frequency is in the range of about 5.725 to 5.825 GHz. In still other embodiments, the second frequency is in a broad range of about 4.9 to 5.825 GHz.

As described herein, the dimensions of the individual components of the multiband antenna element 510 may be determined utilizing RF simulation software such as IE3D. The dimensions of the individual components depend upon the desired operating frequencies, among other things, and are well within the skill of those in the art.

FIG. 6 illustrates a multiband coupling network 600 for coupling the multiband antenna element 510 of FIG. 5 to the multiband communication device 120 of FIG. 1, in one embodiment in accordance with the present invention. Only a single multiband antenna element 510 and multiband coupling network 600 are shown for clarity, although generally the multiband coupling network 600 is included for each multiband antenna element 510 in the planar antenna apparatus 110 of FIG. 1. Although described as a dual-band embodiment, the multiband coupling network 600 may be modified to enable virtually any number of bands.

As described with respect to FIGS. 2-4, the radio frequency feed port 220 provides an interface to the multiband communication device 120, for example as an attachment for a coaxial cable from the communication device 120. In a low band RF path, a first RF switch 610, such as a PIN diode, a GaAs FET, or virtually any RF switching device known in the art (shown schematically as a PIN diode) selectively couples the radio frequency feed port 220 through a low band filter (also referred to as a bandpass filter or BPF) 620 to point A of the multiband antenna element 510. The low band filter 620 includes well-known circuitry comprising resistors, capacitors, and/or inductors configured to pass low band frequencies and not pass high band frequencies. A low band control signal (LB CTRL) may be pulled or biased low to turn on the RF switch 610.

In a high band RF path, a second RF switch 630 (shown schematically as a PIN diode) selectively couples the radio frequency feed port 220 through a high band filter 640 to point A of the multiband antenna element 510. The high band filter 640 includes well-known circuitry comprising resistors, capacitors, and/or inductors configured designed to pass high band frequencies and not pass low band frequencies. A high band control signal (HB CTRL) may be "pulled low" to turn on the RF switch 630. DC blocking capacitors (not labeled) prevent the control signals from interfering with the RF paths.

As described further with respect to FIGS. 7 and 8, the low band RF path and the high band RF path may have the same predetermined path delay. Having the same path delay, for example ¼-wavelength for both low band and high band, simplifies matching in the multiband coupling network 600.

The multiband coupling network 600 allows full-duplex, simultaneous and independent selection of multiband antenna elements 510 for low band and high band. For example, in a 4-element configuration similar to FIG. 2 with each antenna element including the multiband coupling network 600 and the multiband antenna element 510, a first group of two multiband antenna elements 510 may be selected for low band, while at the same time a different group of three multiband antenna elements 510 may be selected for high band. In this way, low band RF can be transmitted in one radiation pattern or directional orientation for a first packet, and high band RF can be simultaneously transmitted in another radiation pattern or directional orientation for a second packet (assuming the multiband communication device 120 includes two independent MACs).

FIG. 7 illustrates an enlarged view of a partial PCB layout for a multiband coupling network 700 between the multiband communication device 120 of FIG. 1 and the multiband antenna element 510 of FIG. 5, in one embodiment in accordance with the present invention. Only one multiband antenna element 510 is shown for clarity, although the multiband coupling network 700 may be utilized for each multiband antenna element 510 included in the planar antenna apparatus 110. The embodiment of FIG. 7 may be used for a multiband communication device 120 that uses full-duplex, simultaneous operation on low and high bands as described with respect to FIG. 6. Although described as a dual-band embodiment, it will be apparent to persons of ordinary skill that the multiband coupling network 700 may be modified to enable virtually any number of bands.

In general, the multiband coupling network 700 is similar in principle to that of FIG. 6, however, the band pass filters comprise coupled lines (traces) 720 and 740 on the substrate (PCB). The coupled lines 720 comprise meandered lines configured to pass low band frequencies from about 2.4 to 2.4835 GHz. The physical length of the coupled lines 720 is determined so that low band frequencies at the output of the coupled lines 720 at the point A are delayed by ¼-wavelength (or odd multiples thereof) with respect to the radio frequency feed port 220.

The coupled lines 740 are also formed from traces on the PCB, and are configured as a BPF to pass high band frequencies from about 4.9 to 5.825 GHz. The physical length of the coupled lines 740 is determined so that low band frequencies at the output of the coupled lines 740 at the point A are delayed by ¼-wavelength (or odd multiples thereof) with respect to the radio frequency feed port 220.

A first RF switch 710, such as a PIN diode, a GaAs FET, or virtually any RF switching device known in the art (shown schematically as a PIN diode) selectively couples the radio frequency feed port 220 through the low band coupled lines 720 to the point A of the multiband antenna element 510. A low band control signal (LB CTRL) and DC blocking capacitor (not labeled) are configured to turn the RF switch 710 on/off.

A second RF switch 730, such as a PIN diode, a GaAs FET, or virtually any RF switching device known in the art selectively couples the radio frequency feed port 220 through the high band coupled lines 740 to the point A of the multiband antenna element 510. A high band control signal (HB CTRL) and DC blocking capacitor (not labeled) are configured to turn the RF switch 740 on/off.

An advantage of the multiband coupling network 700 is that the coupled lines 720 and 740 comprise traces on the substrate and as such may be made within a very small area on the substrate. Further, the coupled lines 720 and 740 require no components such as resistors, capacitors, and/or inductors, or diplexers, and are essentially free to include on the substrate.

Another advantage is that the ¼-wavelength of the coupled lines 720 is at the same point as the ¼-wavelength of the coupled lines 740. For example, if either the RF switch 710 or 730 is off representing a high-impedance, there is no or minimal influence at the point A. The multiband coupling network 700 therefore allows for independent coupling of low band and/or high band to the multiband antenna element 510.

Further, in one embodiment, because the coupled lines 720 and 740 are effective at blocking DC, only one of the DC blocking capacitors is included after the RF switches 710 and 730. Such a configuration further reduces the size and cost of the multiband coupling network 700.

FIG. 8 illustrates an enlarged view of a partial PCB layout for a multiband coupling network 800 between the multiband communication device 120 of FIG. 1 and the multiband antenna element 510 of FIG. 5, in one embodiment in accordance with the present invention. Only one multiband antenna element 510 is shown for clarity, although the multiband coupling network 800 may be utilized for each multiband antenna element 510 included in the planar antenna apparatus 110. The embodiment of FIG. 8 may be used for a multiband communication device 120 that does not use full-duplex, simultaneous operation on multiple bands, but that may alternatively use one band. Although described as a dual-band embodiment, it will be apparent to persons of ordinary skill that the multiband coupling network 800 may be modified to enable virtually any number of bands.

As compared to the in-series RF switches in the multiband coupling network 700 of FIG. 7, an RF switch 810 is configured in shunt operation so that a select signal, when pulled or biased low, turns on the RF switch 810. The coupled lines 820 and 840 are configured such that the point A is ¼-wavelength in distance from the radio frequency feed port 220 for both low band and high band.

Therefore, if the RF switch 810 is open or off (high impedance to ground), the radio frequency feed port 220 "sees" low impedance through the coupled lines 820 or 840 to the multiband antenna element 510, and the multiband antenna element 510 is switched on. If the RF switch 810 is closed or on (low impedance to ground), then the radio frequency feed port 220 sees high impedance, and the multiband antenna element 510 is switched off. In other words, if the multiband antenna element 510 is DC-biased low, a ¼-wavelength away at the input to the coupled lines 820 and 840 the radio frequency feed port 220 sees an open, so the multiband antenna element 510 is off.

An advantage of the multiband coupling network 800 is less insertion loss, because the RF switch 810 is not in the path of energy from the radio frequency feed port 220 to the multiband antenna element 510. Further, because the RF switch 810 is not in the path of energy from the radio frequency feed port 220 to the multiband antenna element 510, isolation may be improved as compared to series RF switching. Isolation improvement may be particularly important in an embodiment where the multiband communication device 120 and planar antenna apparatus 110 are capable of multiple-in, multiple-out (MIMO) operation, as described in co-pending U.S. application Ser. No. 11/190,288 titled "Wireless System Having Multiple Antennas and Multiple Radios" filed Jul. 26, 2005, incorporated by reference herein.

Another advantage of the multiband coupling network 800 is that only a single RF switch 810 is needed to enable the multiband antenna element 510 for low or high band operation. Further, in an embodiment with a PIN diode for the RF switch 810, the PIN diode has 0.17 pF of stray capacitance. With the RF switch 810 not in the path of energy from the radio frequency feed port 220 to the multiband antenna element 510, it is possible that matching problems may be reduced because of the stray capacitance, particularly at frequencies above about 4-5 GHz.

Although not shown, the RF switches of FIGS. 2-8 may be improved by placing one or more inductors in parallel with the RF switches, as described in co-pending U.S. patent application Ser. No. 11/413,670, filed Apr. 28, 2006, titled "PIN Diode Network for Multiband RF Coupling," incorporated by reference herein.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. An antenna apparatus comprising:

a substrate having a first layer and a second layer;

a plurality of antenna elements on the first layer, each of the plurality of antenna elements including a first antenna element configured to radiate at a first radio frequency and a second antenna element configured to radiate at a second radio frequency;

an antenna element selector coupled to the plurality of antenna elements, the antenna element selector configured to selectively couple the antenna elements to a communication device for generating the first radio frequency and the second radio frequency; and a ground component on the second layer, the ground component including a first portion corresponding to the first antenna element and a second portion corresponding to the second antenna element.

2. The antenna apparatus of claim 1 wherein the antenna element selector comprises a PIN diode network.

3. The antenna apparatus of claim 1 wherein the plurality of antenna elements is configured to radiate in an omnidirectional radiation pattern when two or more of the antenna elements are coupled to the communication device.

4. The antenna apparatus of claim 1, wherein the antenna element selector is configured to concurrently couple a first group of the plurality of antenna elements to the first radio frequency and a second group of the plurality of antenna elements to the second radio frequency.

5. The antenna apparatus of claim 1, wherein a combined radiation pattern resulting from two or more antenna elements being coupled to the communication device is more directional than the radiation pattern of a single antenna element.

6. The antenna apparatus of claim 1 wherein the first radio frequency is in a range of 2.4 to 2.4835 GHz and the second radio frequency is in a range of 4.9 to 5.825 GHz.

7. The antenna apparatus of claim 1 wherein the ground component includes a reflector configured to concentrate the directional radiation pattern of the first antenna element and the corresponding first portion of the ground component.

8. The antenna apparatus of claim 1 wherein the ground component includes a reflector configured to broaden a frequency response of the first antenna element and the corresponding first portion of the ground component.

9. The antenna apparatus of claim 1 wherein the first antenna element and the corresponding first portion of the ground component and the second antenna element and the corresponding second portion of the ground component comprise a dual resonant structure.

10. The antenna apparatus of claim 1, wherein the first antenna element and the corresponding first portion of the ground component comprise an arrow-shaped bent element.

11. An antenna apparatus comprising:

a substrate having a first layer and a second layer;

an antenna element on the first layer, the antenna element including a first antenna element configured to radiate at a first radio frequency and a second antenna element configured to radiate at a second radio frequency; and a ground component on the second layer, the ground component including a first portion corresponding to the first antenna element, a second portion corresponding to the second antenna element, and a reflector configured to concentrate the directional radiation pattern of the first antenna element and corresponding first portion of the ground component, and wherein the first antenna element and the corresponding first portion of the ground component and the second antenna element and the corresponding second portion of the ground component comprise a dual resonant structure.

12. The antenna apparatus of claim 11 wherein the first radio frequency is in a range of 2.4 to 2.4835 GHz and the second radio frequency is in a range of 4.9 to 5.825 GHz.

13. An antenna apparatus comprising:

a substrate having a first layer and a second layer;

an antenna element on the first layer, the antenna element including a first antenna element configured to radiate at a first radio frequency and a second antenna element configured to radiate at a second radio frequency; and a ground component on the second layer, the ground component including a first portion corresponding to the first antenna element, a second portion corresponding to the second antenna element, and a reflector configured to broaden a frequency response of the first antenna element and corresponding first portion of the ground component, and wherein the first antenna element and the corresponding first portion of the ground component and the second antenna element and the corresponding second portion of the ground component comprise a dual resonant structure.

14. The antenna apparatus of claim 13 wherein the first radio frequency is in a range of 2.4 to 2.4835 GHz and the second radio frequency is in a range of 4.9 to 5.825 GHz.

15. An antenna apparatus comprising:

a substrate having a first layer and a second layer;

an antenna element on the first layer, the antenna element including a first antenna element configured to radiate at a first radio frequency and a second antenna element configured to radiate at a second radio frequency; and a ground component on the second layer, the ground component including a first portion corresponding to the first antenna element and a second portion corresponding to the second antenna element, the first antenna element and the corresponding first portion of the ground component comprising an arrow-shaped bent element, and wherein the first antenna element and the corresponding first portion of the ground component and the second antenna element and the corresponding second portion of the ground component comprise a dual resonant structure.

16. The antenna apparatus of claim 15 wherein the first radio frequency is in a range of 2.4 to 2.4835 GHz and the second radio frequency is in a range of 4.9 to 5.825 GHz.

* * * * *

UNITED STATES PATENT AND TRADEMARK OFFICE

CERTIFICATE OF CORRECTION

PATENT NO. : 7,652,632 B2
APPLICATION NO. : 11/414117
DATED : January 26, 2010
INVENTOR(S) : Victor Shtrom It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 447 days.

Signed and Sealed this

Twenty-third Day of November, 2010

David J. Kappos

David J. Kappos
*Director of the United States Patent and Trademark Office*